US010495320B2

(12) United States Patent
Torrentes et al.

(10) Patent No.: US 10,495,320 B2
(45) Date of Patent: Dec. 3, 2019

(54) OVEN APPLIANCE WITH SPILL CONTROL AND HEAT REGULATING FEATURES

(71) Applicant: Haier US Appliance Solutions, Inc., Wilmington, DE (US)

(72) Inventors: Marcelo Torrentes, Louisville, KY (US); Joshua Adam Mayne, Louisville, KY (US); Charles Andrew Bierbaum, Louisville, KY (US)

(73) Assignee: Haier US Appliance Solutions, Inc., Wilmington, DE (US)

( * ) Notice: Subject to any disclaimer, the term of this patent is extended or adjusted under 35 U.S.C. 154(b) by 152 days.

(21) Appl. No.: 15/788,926

(22) Filed: Oct. 20, 2017

(65) Prior Publication Data

US 2019/0120505 A1 Apr. 25, 2019

(51) Int. Cl.

| | |
|---|---|
| ***F24C 15/00*** | (2006.01) |
| ***F24C 15/36*** | (2006.01) |
| ***F24C 15/32*** | (2006.01) |

(52) U.S. Cl.

CPC ..... *F24C 15/36* (2013.01); *F24C 15/007* (2013.01); *F24C 15/32* (2013.01)

(58) Field of Classification Search

CPC ..... F24C 15/36; F24C 15/14
USPC ..... 126/39 BA, 80
See application file for complete search history.

(56) References Cited

U.S. PATENT DOCUMENTS

| | | | | |
|---|---|---|---|---|
| 2,339,197 A * | 1/1944 | Rutenber | ..... | F24C 15/32 126/21 R |
| 3,512,514 A * | 5/1970 | Vonasch | ..... | F24C 14/02 126/21 A |
| 5,297,992 A | 3/1994 | Bailey et al. | | |
| 6,172,338 B1 | 1/2001 | Barnes et al. | | |

FOREIGN PATENT DOCUMENTS

| | | |
|---|---|---|
| JP | 5028152 B2 | 9/2012 |
| JP | 5473833 B2 | 4/2014 |
| WO | WO2017114624 A1 | 7/2017 |

* cited by examiner

*Primary Examiner* — Avinash A Savani
(74) *Attorney, Agent, or Firm* — Dority & Manning, P.A.

(57) ABSTRACT

An oven appliance having an oven chamber positioned within a cabinet and a top panel defining one or more vent apertures includes a false back assembly for facilitating the containment of spilled fluids and the cooling of electronic components within the cabinet. The false back assembly includes a false back spaced apart from a range back to define a spill channel. A spill deflector is positioned below the vent apertures and above the spill channel along the vertical direction such that the spill deflector is configured for collecting fluids spilled through the vent apertures and directing the spilled fluids to the spill channel where they may be safely routed around sensitive electronic components.

20 Claims, 12 Drawing Sheets

OVEN APPLIANCE WITH SPILL CONTROL AND HEAT REGULATING FEATURES

FIELD OF THE INVENTION

The present subject matter relates generally to oven appliances, and more particularly, to oven appliances with features for protecting electronic components from fluid spills and excessive heat.

BACKGROUND OF THE INVENTION

Conventional residential and commercial oven appliances generally include a cabinet that defines a cooking chamber for receipt of food items for cooking. Multiple heating elements are positioned within the cooking chamber to provide heat to food items located therein. The heating elements can include, for example, radiant heating elements, such as a bake heating assembly positioned at a bottom of the cooking chamber and/or a separate broiler heating assembly positioned at a top of the cooking chamber.

In addition, conventional oven appliances may include a cooktop positioned on a top panel of the appliance. The cooktop may include multiple heating elements for heating utensils placed thereon, such as electric, induction, or gas burner heating elements. Notably, the large amount of heat generated by the heating elements associated with the cooking chamber and/or the cooktop can be detrimental to the operation of the control electronics and other electronic components. In order to vent some of the heated air present in the cabinet of the cooking appliance, the top panel typically includes one or more vent apertures for discharging heated air.

Although the vent apertures facilitate some cooling of electronic components housed within the cabinet, it is often desirable to have improved features for regulating excessive heat. In addition, managing spills proximate the vent apertures can be a common concern. For example, when liquids within a utensil (e.g., pot) boil over and out of the utensil, the liquids may spill through the vent apertures and into the cabinet. Notably, some appliances include one or more electronic components that are mounted within cabinet, and spilled fluids risk significantly damaging such electronics.

Accordingly, an oven appliance that includes one or more features for managing spills would be useful. More particularly, an oven appliance with features for containing spilled fluids within an area away from sensitive electronic components while regulating excessive heat and keeping electronic components cool and dry would be particularly beneficial.

BRIEF DESCRIPTION OF THE INVENTION

The present subject matter provides an oven appliance having an oven chamber positioned within a cabinet and a top panel defining one or more vent apertures. The oven appliance includes a false back assembly for facilitating the containment of spilled fluids and the cooling of electronic components within the cabinet. The false back assembly includes a false back spaced apart from a range back to define a spill channel. A spill deflector is positioned below the vent apertures and above the spill channel along the vertical direction such that the spill deflector is configured for collecting fluids spilled through the vent apertures and directing the spilled fluids to the spill channel where they may be safely routed around sensitive electronic components. Additional aspects and advantages of the invention will be set forth in part in the following description, or may be apparent from the description, or may be learned through practice of the invention.

In a first example embodiment, an oven appliance defining a vertical, a lateral, and a transverse direction is provided. The oven appliance includes a cabinet extending between a top and a bottom along the vertical direction and a top panel positioned proximate the top of the cabinet, the top panel including vent trim defining one or more vent apertures. An oven chamber is positioned within the cabinet and being defined at least in part by a rear chamber wall and a range back is spaced apart from the rear chamber wall along the transverse direction to define an insulation gap. A false back assembly includes a false back spaced apart from the range back to define a spill channel and a spill deflector positioned below the vent apertures and above the spill channel along the vertical direction, the spill deflector configured for collecting fluids spilled through the vent apertures and directing the spilled fluids to the spill channel.

In a second example embodiment, a false back assembly for an oven appliance is provided. The oven appliance defines a vertical, a lateral, and a transverse direction and includes a cabinet including a top panel defining one or more vent apertures and a range back positioned within the cabinet. The false back assembly includes a false back spaced apart from the range back to define a spill channel and a spill deflector positioned below the vent apertures and above the spill channel along the vertical direction, the spill deflector configured for collecting fluids spilled through the vent apertures and directing the spilled fluids to the spill channel.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

Figure 1:
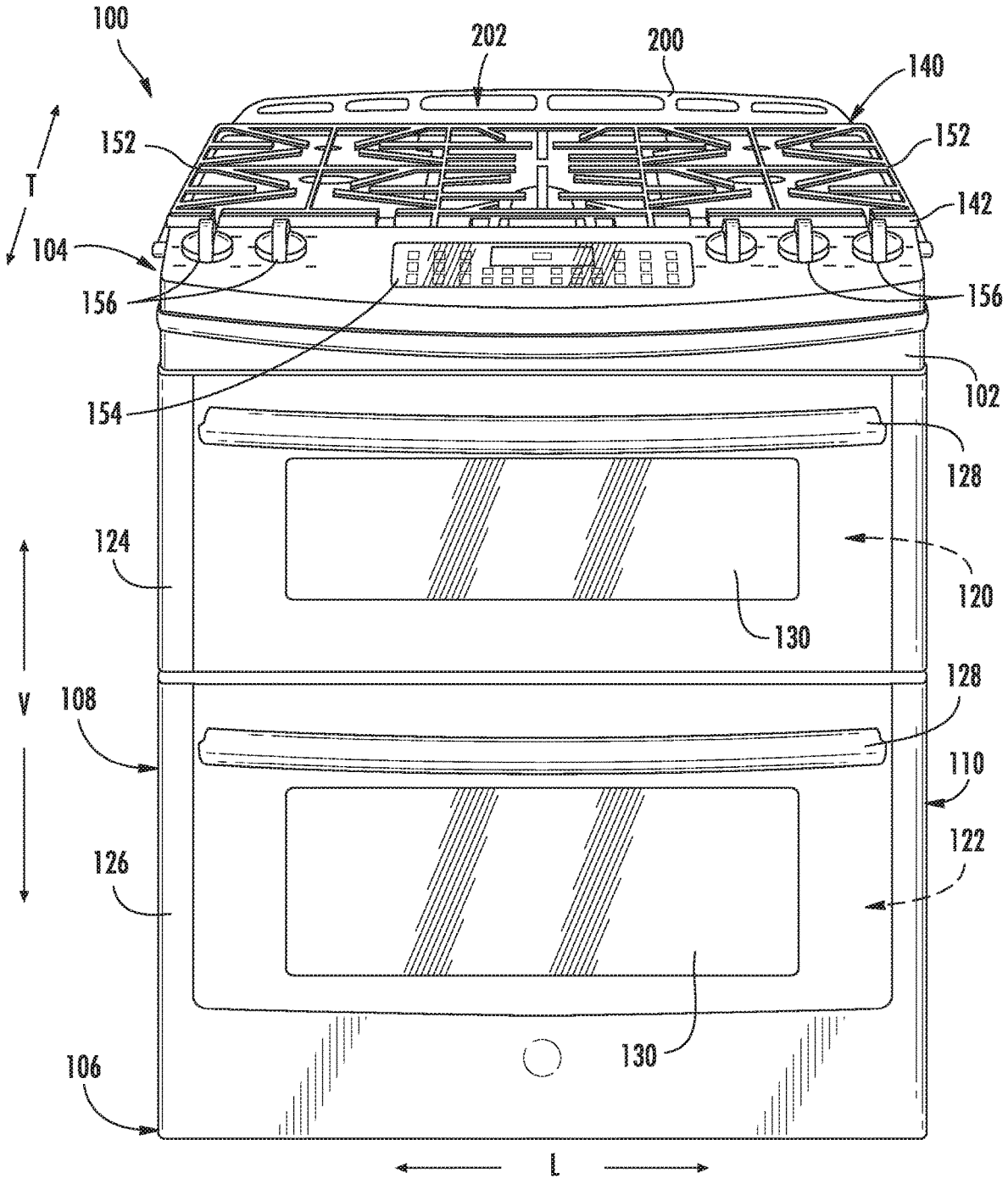
FIG. 1 is a front, perspective view of a oven appliance according to an exemplary embodiment of the present subject matter.

Repeat use of reference characters in the present specification and drawings is intended to represent the same or analogous features or elements of the present invention.

DETAILED DESCRIPTION

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

Figure 2:
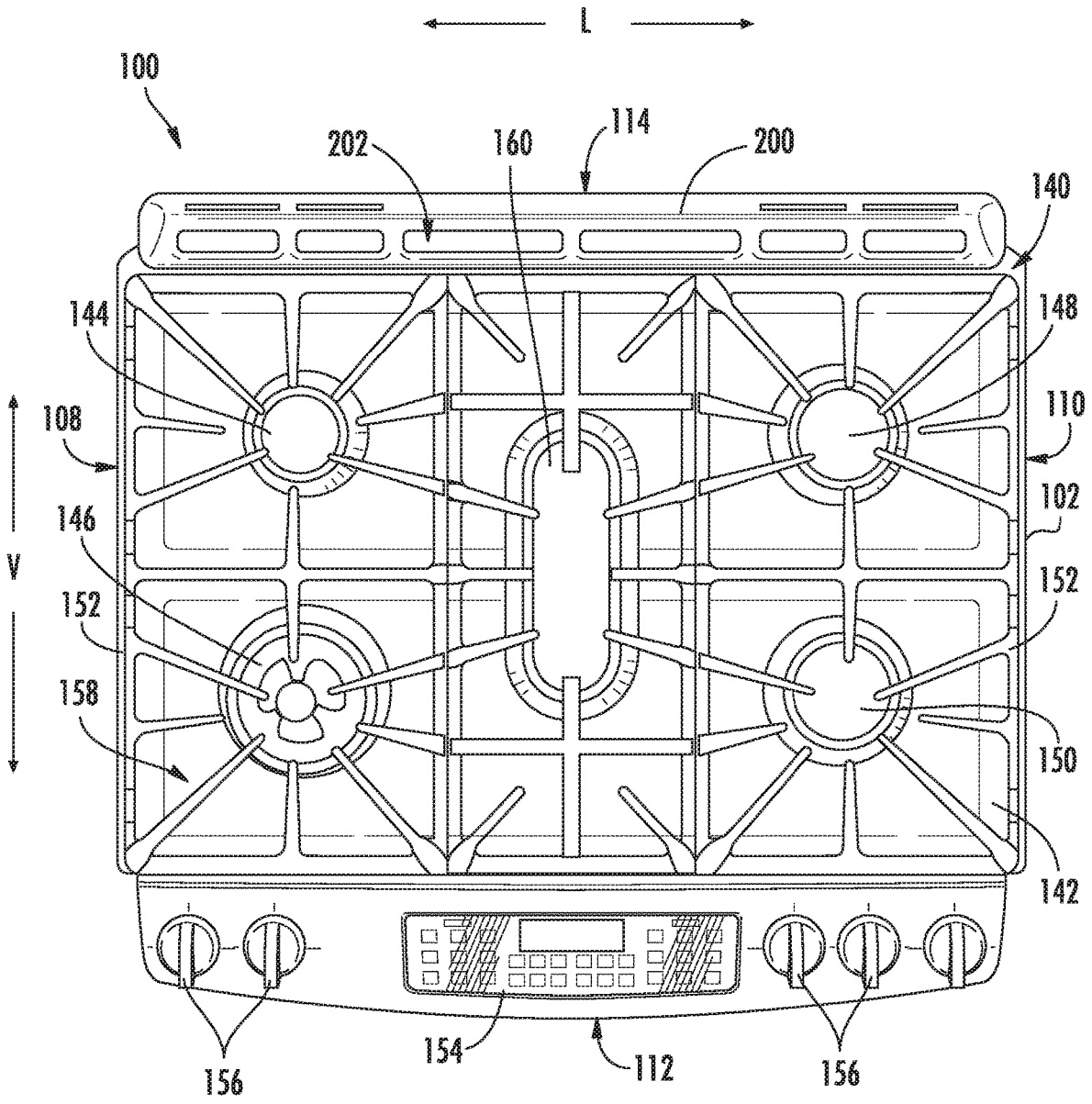
FIG. 2 is a top, plan view of the exemplary oven appliance of FIG. 1.

FIG. 1 provides a front, perspective view of an oven appliance 100 as may be employed with the present subject matter. FIG. 2 provides a top, plan view of oven appliance 100. Oven appliance 100 includes an insulated cabinet 102. Cabinet 102 defines an upper cooking chamber 120 and a lower cooking chamber 122. Thus, oven appliance 100 is generally referred to as a double oven range appliance. As will be understood by those skilled in the art, oven appliance 100 is provided by way of example only, and the present subject matter may be used in any suitable appliance, e.g., a gas or electric single oven range appliance. Thus, the example embodiment shown in FIG. 1 is not intended to limit the present subject matter to any particular cooking chamber configuration or arrangement.

As illustrated, oven appliance 100 generally defines a vertical direction V, a lateral direction L, and a transverse direction T, each of which is mutually perpendicular, such that an orthogonal coordinate system is generally defined. Cabinet 102 of oven appliance 100 extends between a top 104 and a bottom 106 along the vertical direction V, between a first side 108 (left side when viewed from front) and a second side 110 (right side when viewed from front) along the lateral direction L, and between a front 112 and a rear 114 along the transverse direction T.

Figure 9:
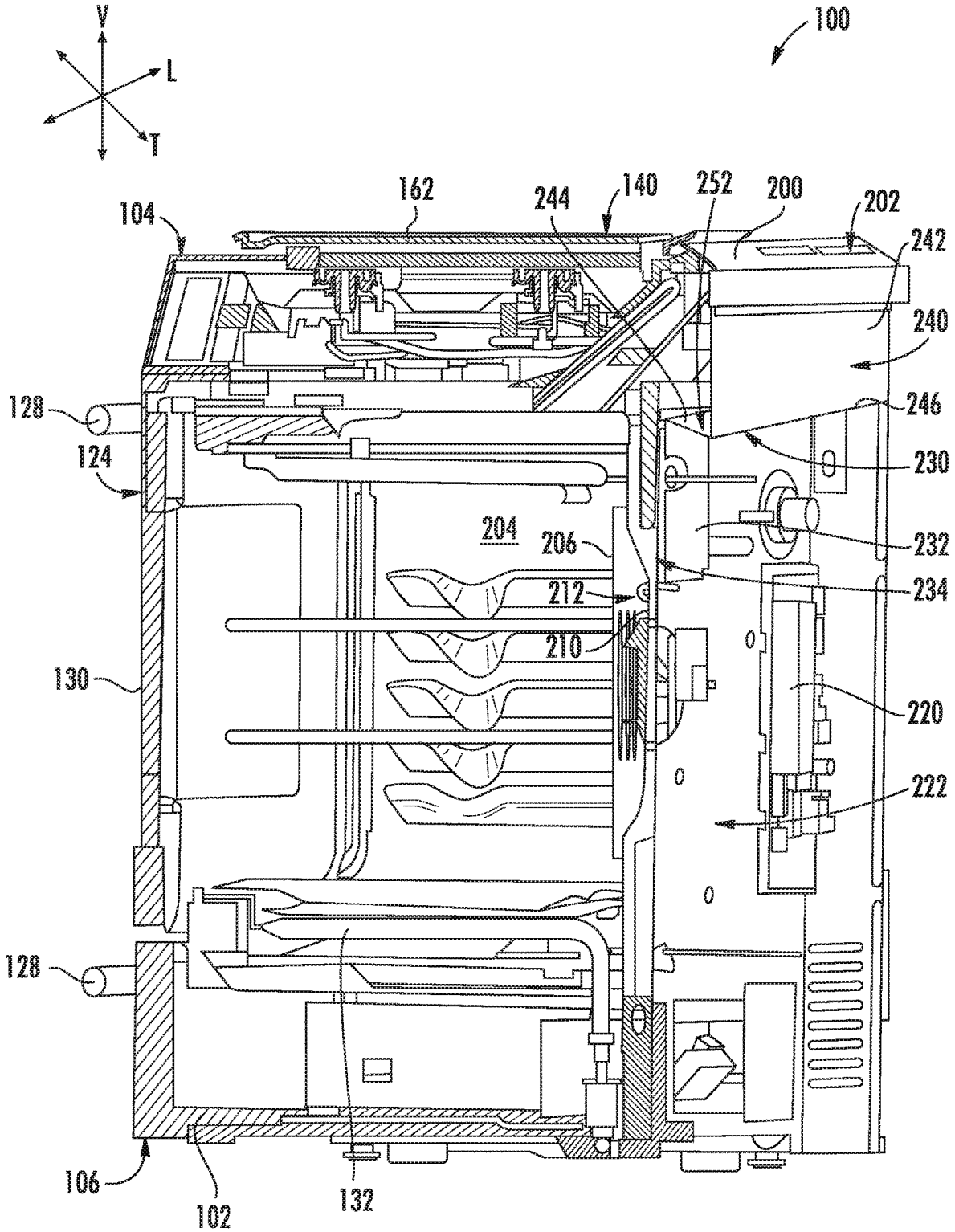
FIG. 9 is a perspective, cross-sectional view of an oven appliance according to another exemplary embodiment of the present subject matter.
Figure 10:
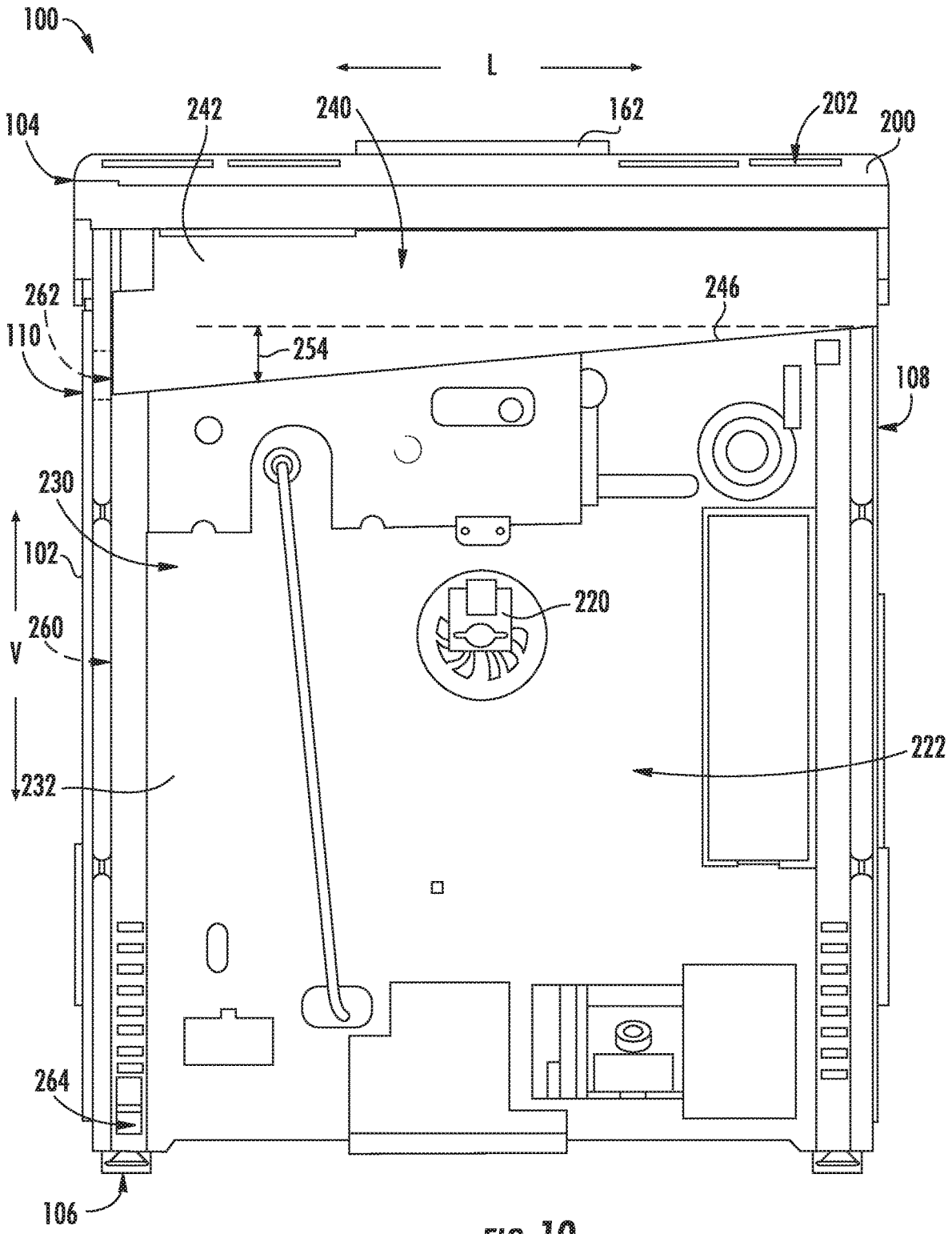
FIG. 10 is a rear view of the exemplary oven appliance of FIG. 9 with a back panel removed according to an exemplary embodiment of the present subject matter.
Figure 11:
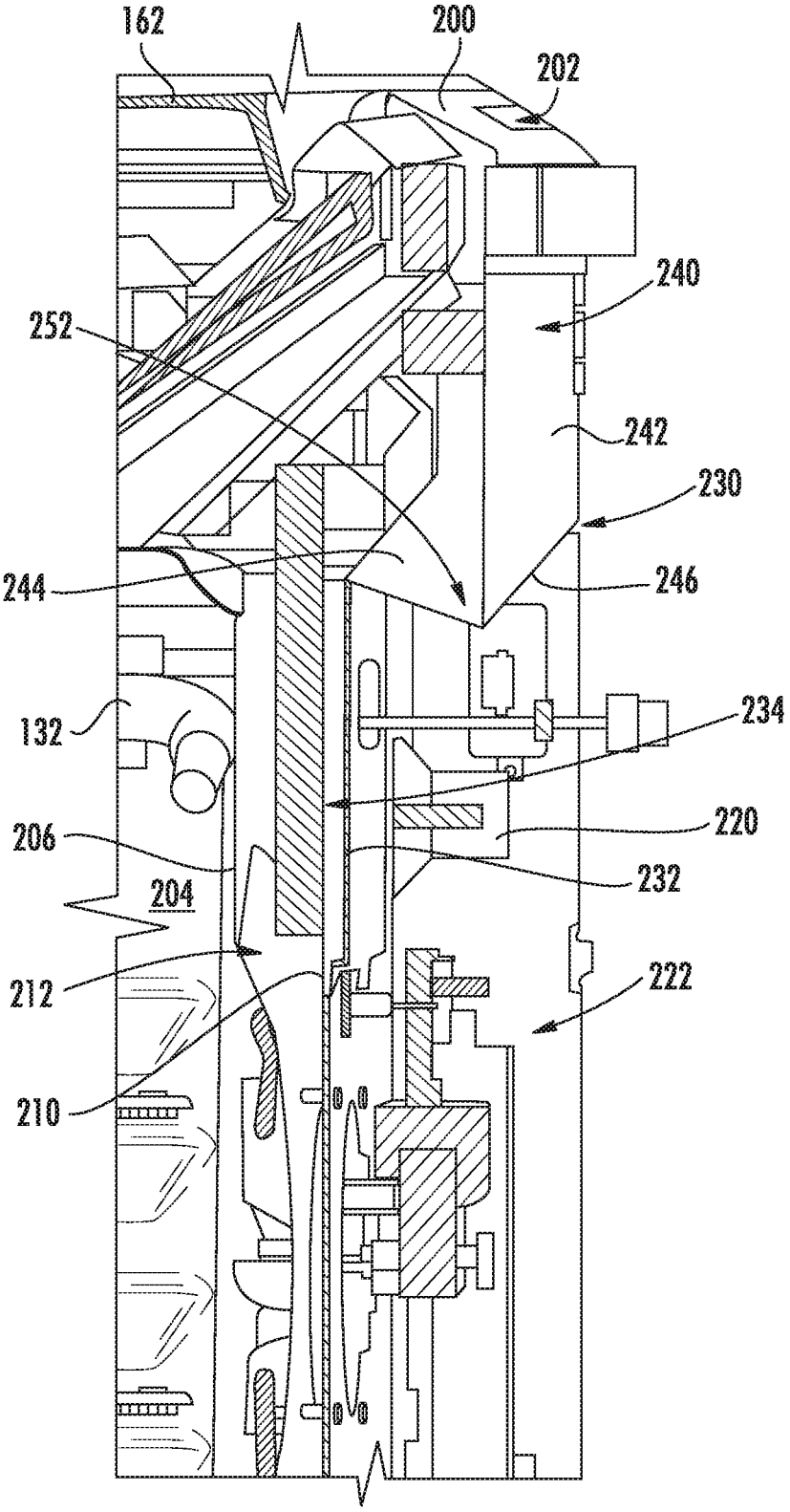
FIG. 11 is a perspective, cross-sectional view of the exemplary oven appliance of FIG. 9 according to an exemplary embodiment of the present subject matter.
Figure 12:
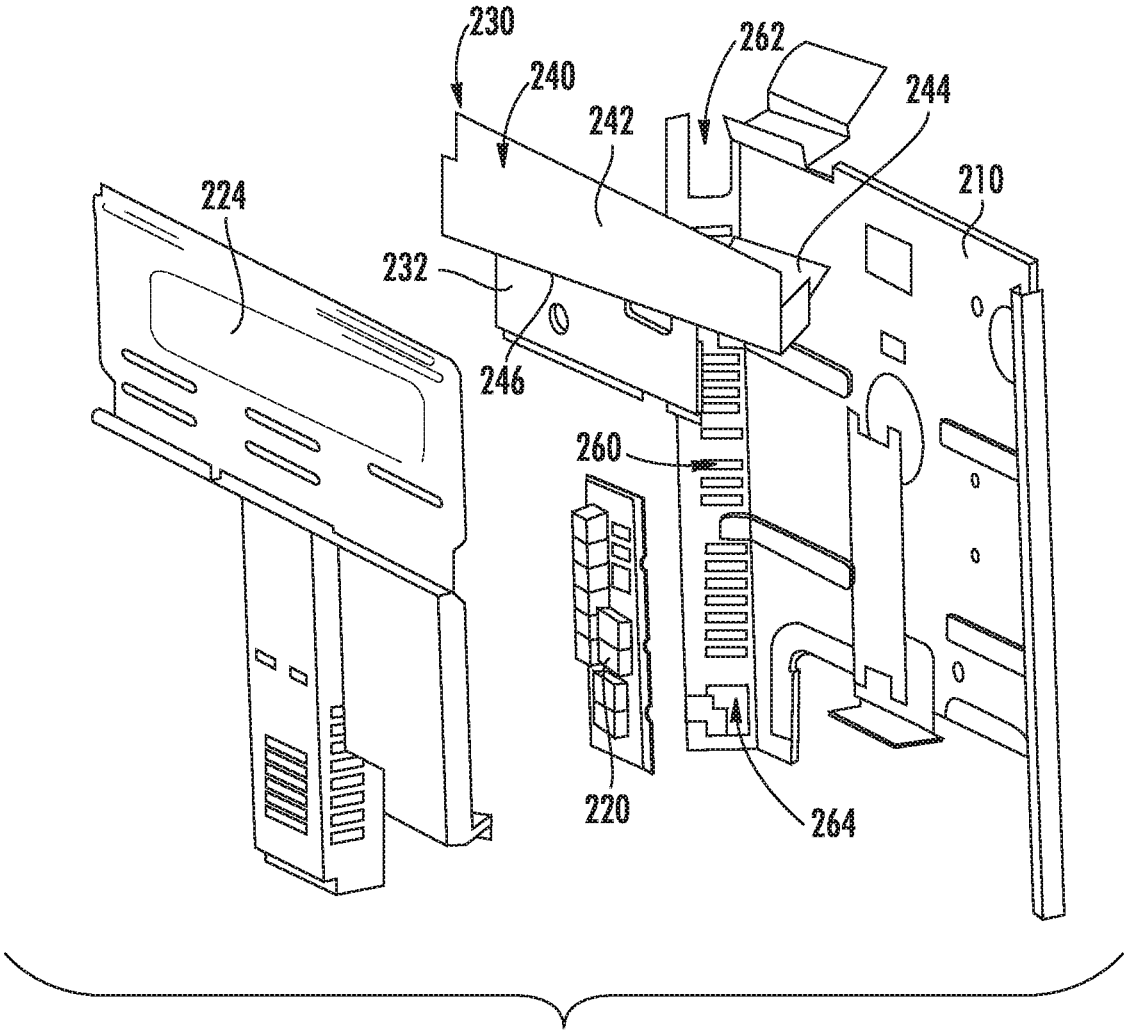
FIG. 12 is an exploded view of certain components of the exemplary oven appliance of FIG. 9 and a false back assembly according to an exemplary embodiment of the present subject matter.

Upper and lower cooking chambers 120 and 122 are configured for the receipt of one or more food items to be cooked. Oven appliance 100 includes an upper door 124 and a lower door 126 rotatably attached to cabinet 102 in order to permit selective access to upper cooking chamber 120 and lower cooking chamber 122, respectively. Handles 128 are mounted to upper and lower doors 124 and 126 to assist a user with opening and closing doors 124 and 126 in order to access cooking chambers 120 and 122. As an example, a user can pull on handle 128 mounted to upper door 124 to open or close upper door 124 and access upper cooking chamber 120. Glass window panes 130 provide for viewing the contents of upper and lower cooking chambers 120 and 122 when doors 124 and 126 are closed and also assist with insulating upper and lower cooking chambers 120 and 122. Heating elements 132 (FIGS. 6 and 9), such as electric resistance heating elements, gas burners, microwave heating elements, halogen heating elements, or suitable combinations thereof, are positioned within upper cooking chamber 120 and lower cooking chamber 122 for heating upper cooking chamber 120 and lower cooking chamber 122.

Oven appliance 100 also includes a cooktop 140. Cooktop 140 is positioned at or adjacent a top portion of cabinet 102. Thus, cooktop 140 is positioned above upper and lower cooking chambers 120 and 122. Cooktop 140 includes a top panel 142 positioned proximate top 104 of cabinet 102. By way of example, top panel 142 may be constructed of glass, ceramics, enameled steel, and combinations thereof. A plurality of burner assemblies 144, 146, 148, 150 are mounted within or on top of top panel 142.

Figure 3:
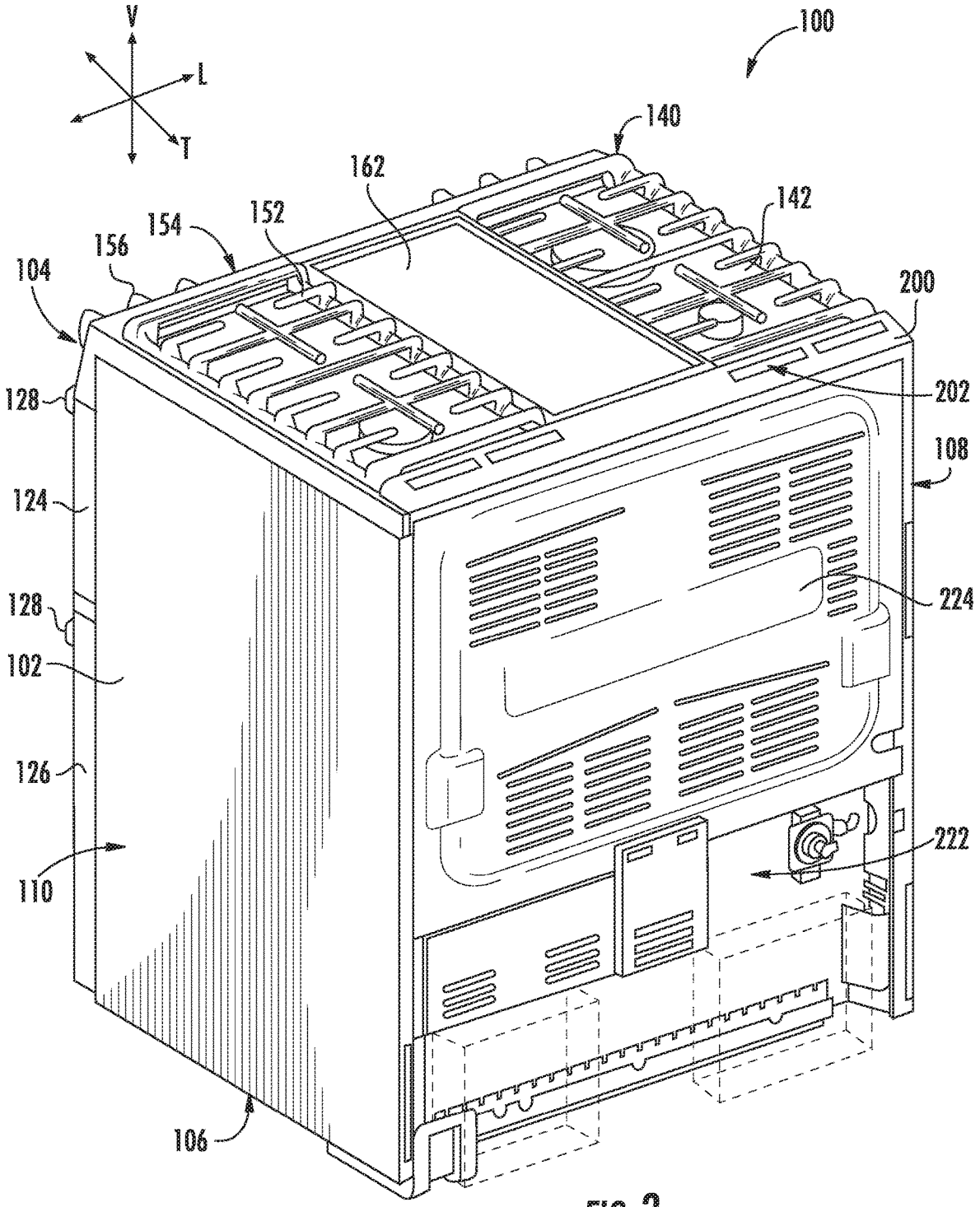
FIG. 3 is a rear, perspective view of the exemplary oven appliance of FIG. 1 according to an exemplary embodiment of the present subject matter.
Figure 4:
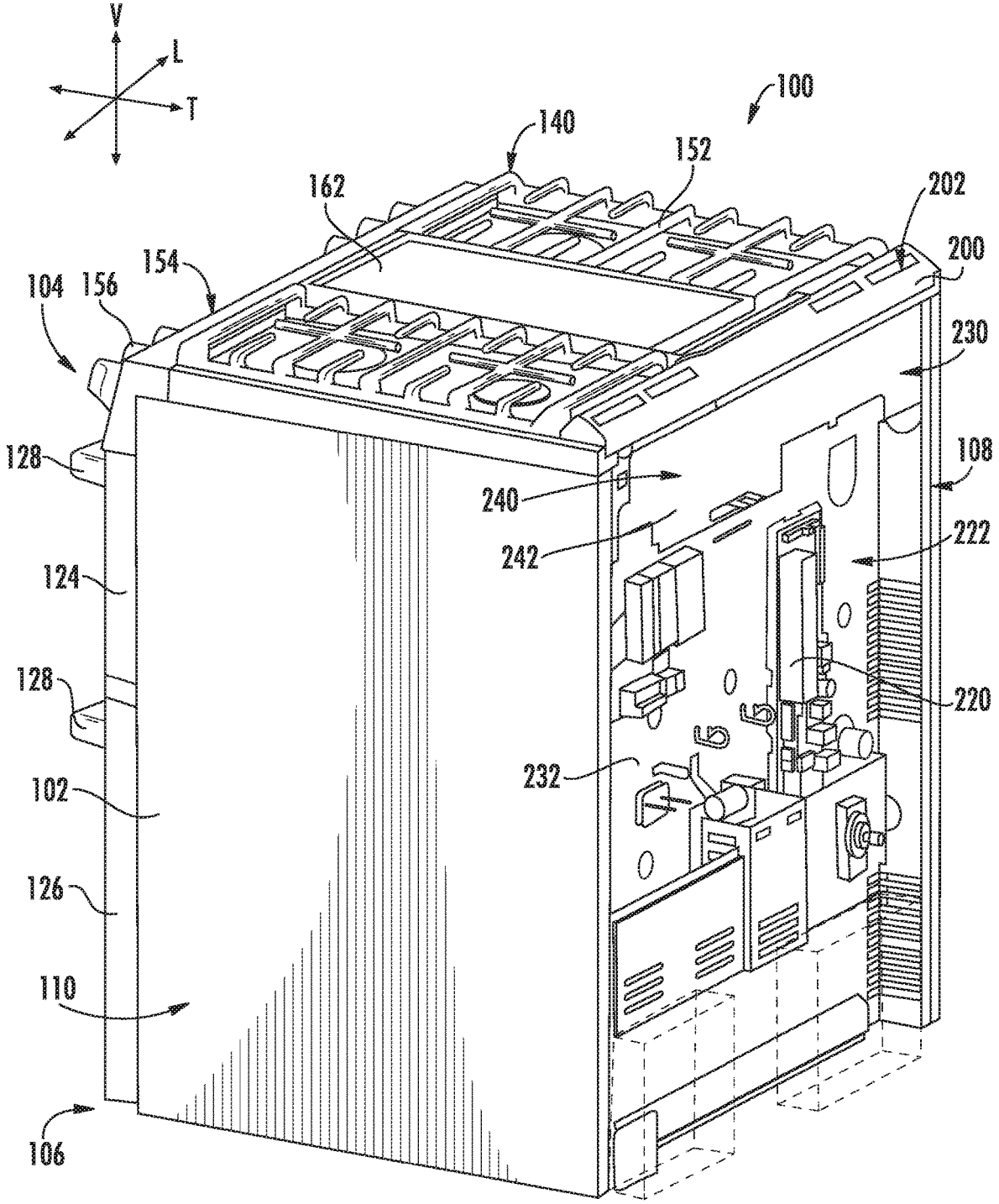
FIG. 4 is a rear, perspective view of the exemplary oven appliance of FIG. 1 with a back panel removed to reveal an electronics compartment according to an exemplary embodiment of the present subject matter.
Figure 5:
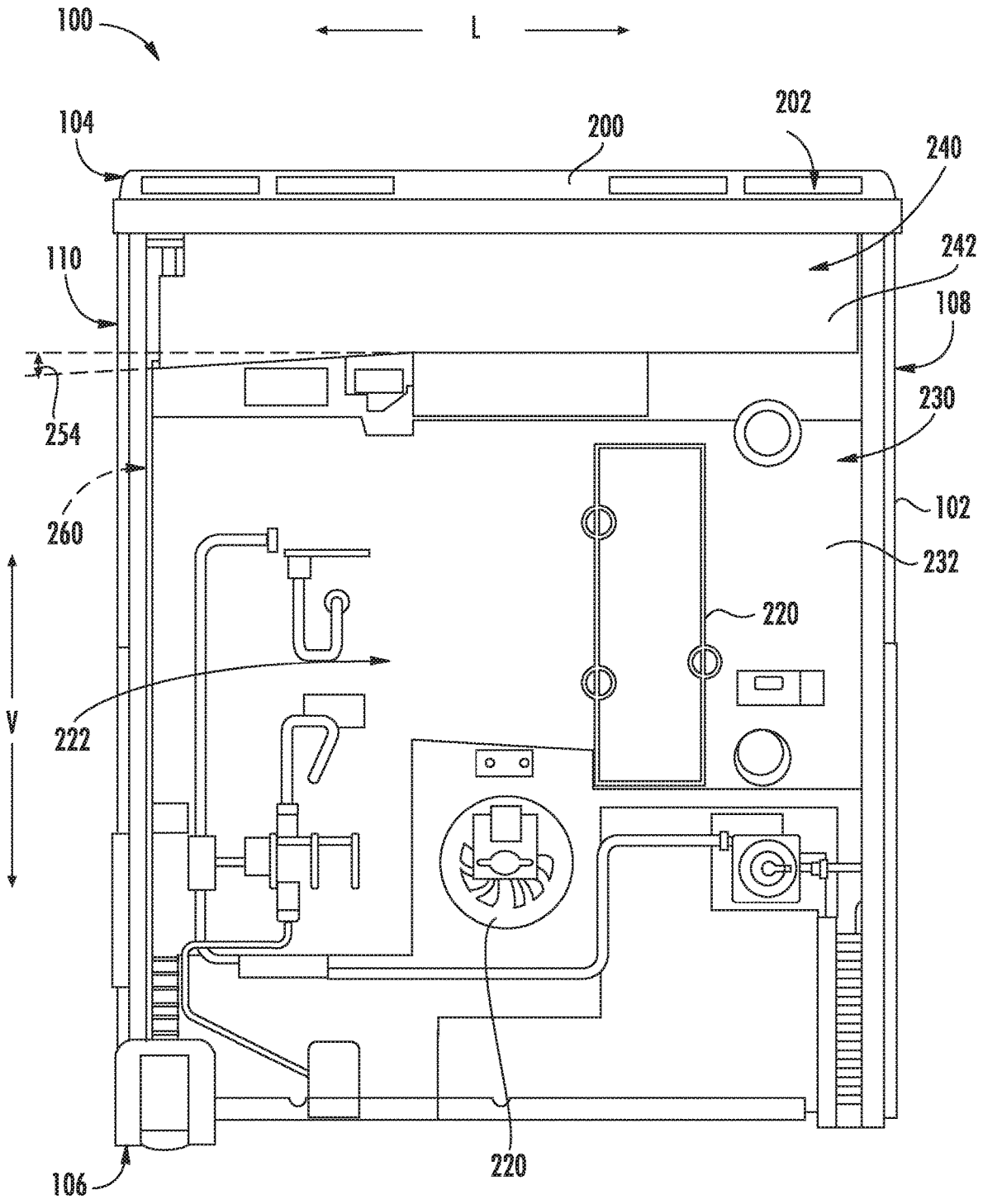
FIG. 5 is a rear view of the exemplary oven appliance of FIG. 1 with the back panel removed according to an exemplary embodiment of the present subject matter.

For oven appliance 100, a utensil holding food and/or cooking liquids (e.g., oil, water, etc.) may be placed onto grates 152 at a location of any of burner assemblies 144, 146, 148, 150. Burner assemblies 144, 146, 148, 150 provide thermal energy to cooking utensils on grates 152. As shown in FIG. 1, burners assemblies 144, 146, 148, 150 can be configured in various sizes so as to provide e.g., for the receipt of cooking utensils (i.e., pots, pans, etc.) of various sizes and configurations and to provide different heat inputs for such cooking utensils. Grates 152 are supported on a top surface 158 of top panel 142. Oven appliance 100 also includes a griddle burner 160 positioned at a middle portion of top panel 142, as may be seen in FIG. 2. As shown in FIGS. 3 and 4, a flat griddle 162 may be positioned on grates 152 and heated with griddle burner 160 according to an exemplary embodiment.

A user interface panel 154 is located within convenient reach of a user of the oven appliance 100. For this example embodiment, user interface panel 154 includes knobs 156 that are each associated with one of burner assemblies 144, 146, 148, 150 and griddle burner 160. Knobs 156 allow the user to activate each burner assembly and determine the amount of heat input provided by each burner assembly 144, 146, 148, 150 and griddle burner 160 to a cooking utensil located thereon. User interface panel 154 may also be provided with one or more graphical display devices that deliver certain information to the user such as e.g., whether a particular burner assembly is activated and/or the rate at which the burner assembly is set.

Although shown with knobs 156, it should be understood that knobs 156 and the configuration of oven appliance 100 shown in FIG. 1 is provided by way of example only. More specifically, user interface panel 154 may include various input components, such as one or more of a variety of touch-type controls, electrical, mechanical or electro-mechanical input devices including rotary dials, push buttons, and touch pads. The user interface panel 154 may include other display components, such as a digital or analog display device designed to provide operational feedback to a user.

Although aspects of the present subject matter are described herein in the context of a double oven appliance, it should be appreciated that oven appliance 100 is provided by way of example only. Other oven or range appliances having different configurations, different appearances, and/ or different features may also be utilized with the present subject matter as well, e.g., single ovens, electric cooktop ovens, induction cooktops ovens, etc. Moreover, aspects of the present subject matter may be used in any other consumer or commercial appliance where it is desirable to contain spills and regulate excessive heat.

Referring now generally to FIGS. 2 through 8, a false back assembly 200 will be described in more detail according to various exemplary embodiments of the present subject matter. Although the discussion below refers to false assembly 200 as used in a double oven or range appliance 100, one skilled in the art will appreciate that the features and configurations described may be used for other false back assemblies in other cooking appliances as well. For example, false back assembly 200 may be positioned in another location or orientation within cabinet 102 and may be shaped to contain or direct spills in any other suitable manner. Other variations and modifications of the exemplary embodiment described below are possible, and such variations are contemplated as within the scope of the present subject matter.

Referring now to FIGS. 2 through 4, oven appliance 100 may include one or more pieces of vent trim 200 that are positioned proximate top 104 of cabinet 102. Vent trim 200 defines one or more vent apertures 202 which are generally configured for allowing hot air to escape from within cabinet 102. More specifically, oven appliance 100 may include various pathways to permit hot air to escape regions of cabinet 102 proximate cooking chambers 120, 122, and\or heating elements 132 of oven appliance 100.

According to the illustrated embodiment, vent trim 200 is positioned proximate rear 114 of oven appliance 100 and extends substantially the full width of cabinet 102 between first side 108 second side 110 along the lateral direction L. So positioned, vent trim 200 provides a good path for hot air to escape cabinet 102 without disturbing a user of oven appliance 100. However, the position of vent trim 200 also exposes vent apertures 202 to potential spills of food, water, or other fluids as described below.

According to the illustrated embodiment, vent trim 200 is a separate piece from top panel 142. For example according to one embodiment, vent trim 200 may be a stamped metal plate defining an apex and two slanted sides. Each slanted side of vent trim 200 may define a plurality of elongated slots or vent apertures 202. For example, according to the illustrated embodiment, vent trim 200 defines a total of ten vent apertures 202. However, it should be appreciated that according to alternative embodiments, vent trim 200 could be formed as an integral piece with top panel 142 and may define any suitable number of vent apertures 202 in any suitable position, configuration, and geometry.

As explained above, oven appliance 100 includes one or more cooking chambers 120, 122 positioned within cabinet 102. More specifically, according to the embodiment illustrated in FIGS. 1 through 8, oven appliance 100 is a double oven including upper cooking chamber 120 and lower cooking chamber 122. However, it should be appreciated that oven appliance 100 could instead have a single cooking chamber, for example, as illustrated in FIGS. 9 through 12. In addition, each of these cooking chambers may be heated by gas heating elements, electric heating elements, or any other suitable type of heating elements.

Regardless of the cooking chamber configuration of oven appliance 100, these appliances include a cooking chamber, generally referred to hereafter as cooking chamber 204, which is defined at least in part by a rear chamber wall 206. In addition, in order to insulate cooking chamber 204, oven appliance 100 includes a range back 210 spaced apart from rear chamber wall 206 along the transverse direction T to define an insulation gap 212 there between. According to an exemplary embodiment, insulation gap 212 is filled with insulating material, such as insulating foam or fiberglass, for insulating cooking chamber 204.

Referring now to FIG. 4, oven appliance 100 includes a variety of electronic components 220 which are typically positioned in an electronics compartment 222. For example, according to the illustrated embodiment, electronics compartment 222 is positioned between range back 210 and a rear panel 224 (FIG. 3) of oven appliance 100 along the transverse direction T. Even with the presence of insulating material and insulation gap 212, cooking chamber 204, heating elements 132, and electronic components 220 may tend to generate excessive heat that builds up within cabinet 102 and in electronics compartment 222. Such heat buildup may have a negative effect on the operation of electronic components 220. Therefore, oven appliance 100 may include features for evacuating heated air from within electronics compartment 222, such as through vent trim 200 described above.

Referring now generally FIGS. 4 through 8, oven appliance 100 may further include a false back assembly 230 which is generally configured for providing a pathway to evacuate heat through vent apertures 202 and providing spill containment features to oven appliance 100. As illustrated, false back assembly 230 includes a false back 232 which is spaced apart from range back 210 along the transverse direction T to define a spill channel 234. More specifically, false back 232 is typically a plate of sheet-metal that extends substantially along the vertical direction V such that spill channel 234 defines a thermal break between cooking chamber 204 and electronics compartment 222. More specifically, according to exemplary embodiment, spill channel 234 extends between bottom 106 and top 104 of cabinet 102 such that cool air located toward bottom 106 of cabinet 102 may naturally rise up through spill channel 234 to provide a thermal break and cool electronics compartment 202 and cabinet 102.

As described herein, spill channel 234 is generally configured for providing a pathway for heated air to travel of from electronics compartment 222 toward and out of vent apertures 202 and as a way for collecting, containing, and directing spilled fluids away from sensitive electronic components 220. Spill channel 234 may define a channel thickness 236 suitable for passing such heated air and spill fluids. In general, channel thickness 236 is defined as an average thickness between range back 210 and false back 232 along the transverse direction T. According to the illustrated embodiment, channel thickness 236 is between about five and ten millimeters (approximately 0.25 inches). However, it should be appreciated that channel thickness 236 may be any other suitable size, such as greater than about 2 millimeters, greater than about 10 millimeters, greater than about 25 millimeters, etc.

According to the illustrated embodiment, spill channel 234 extends substantially along the vertical direction V between insulation gap 212 and electronics compartment 222. However, it should be appreciated that as used herein, terms of approximation, such as "approximately," "substantially," or "about," refer to being within a ten percent margin of error. In this regard, for example, although range back 210, false back 232, and spill channel 234 are all illustrated as being vertically oriented, it should be appreciated such an orientation is not required by the present subject matter. In addition, although spill channel 234 is illustrated as having substantially constant channel thickness 236, according to alternative embodiments channel thickness 236 may vary along the vertical direction V and toward the lateral direction L in any suitable manner.

Referring still to FIGS. 2 through 8, false back assembly 230 further includes a spill deflector 240 positioned below vent apertures 202 and above spill channel 234 along the vertical direction V. Spill deflector 240 is thus generally configured for capturing, collecting, and directing fluids spilled through vent apertures 202. More specifically, according to an exemplary embodiment, spill deflector 240 is shaped such that spilled fluids are directed into spill channel 234 (or another spill passageway) so that they may be directed away electronic components 220 and/or out of oven appliance 100.

Figure 6:
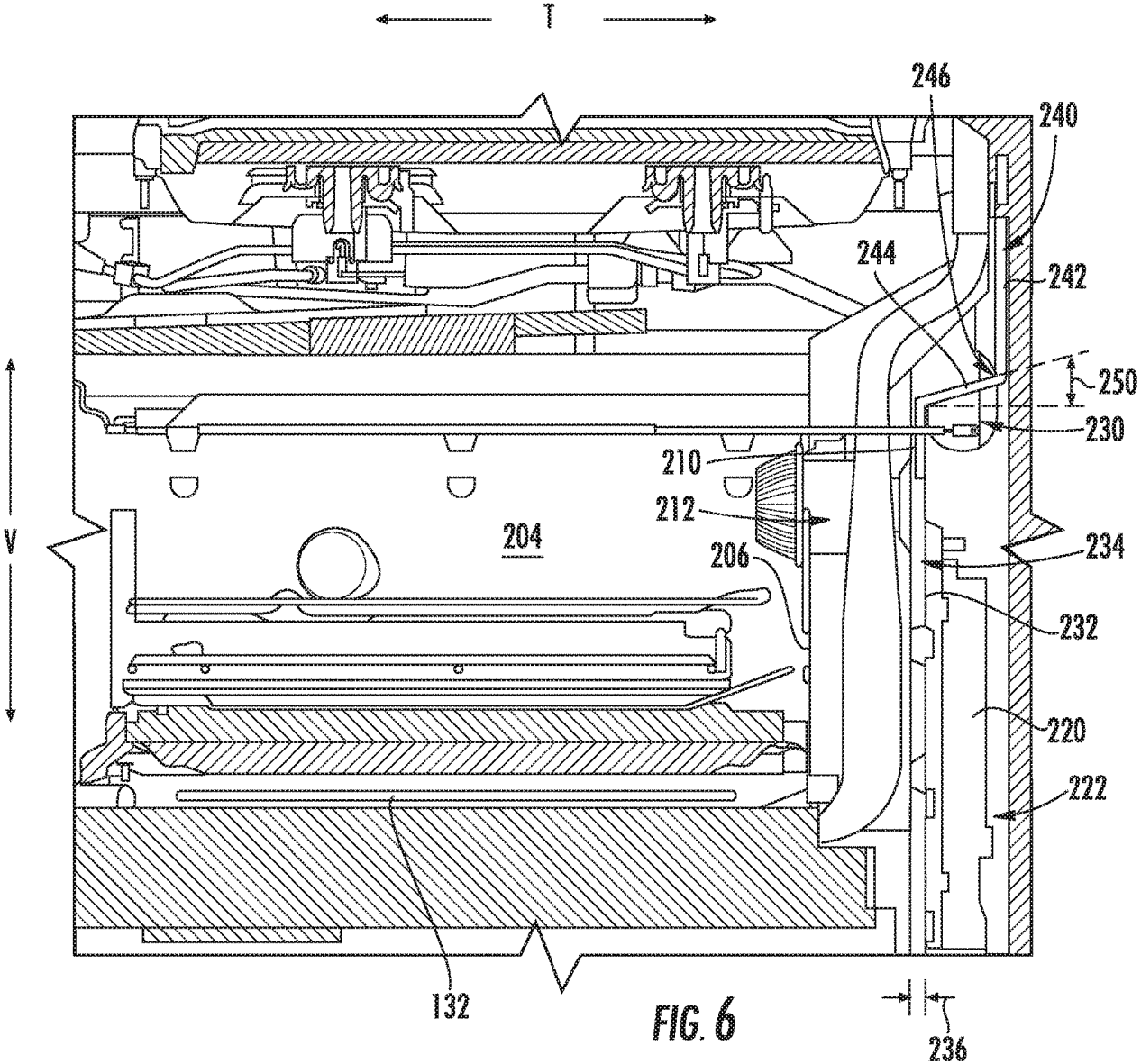
FIG. 6 is a cross-sectional view of the exemplary oven appliance of FIG. 1, taken along Line 6-6 of FIG. 1.
Figure 7:
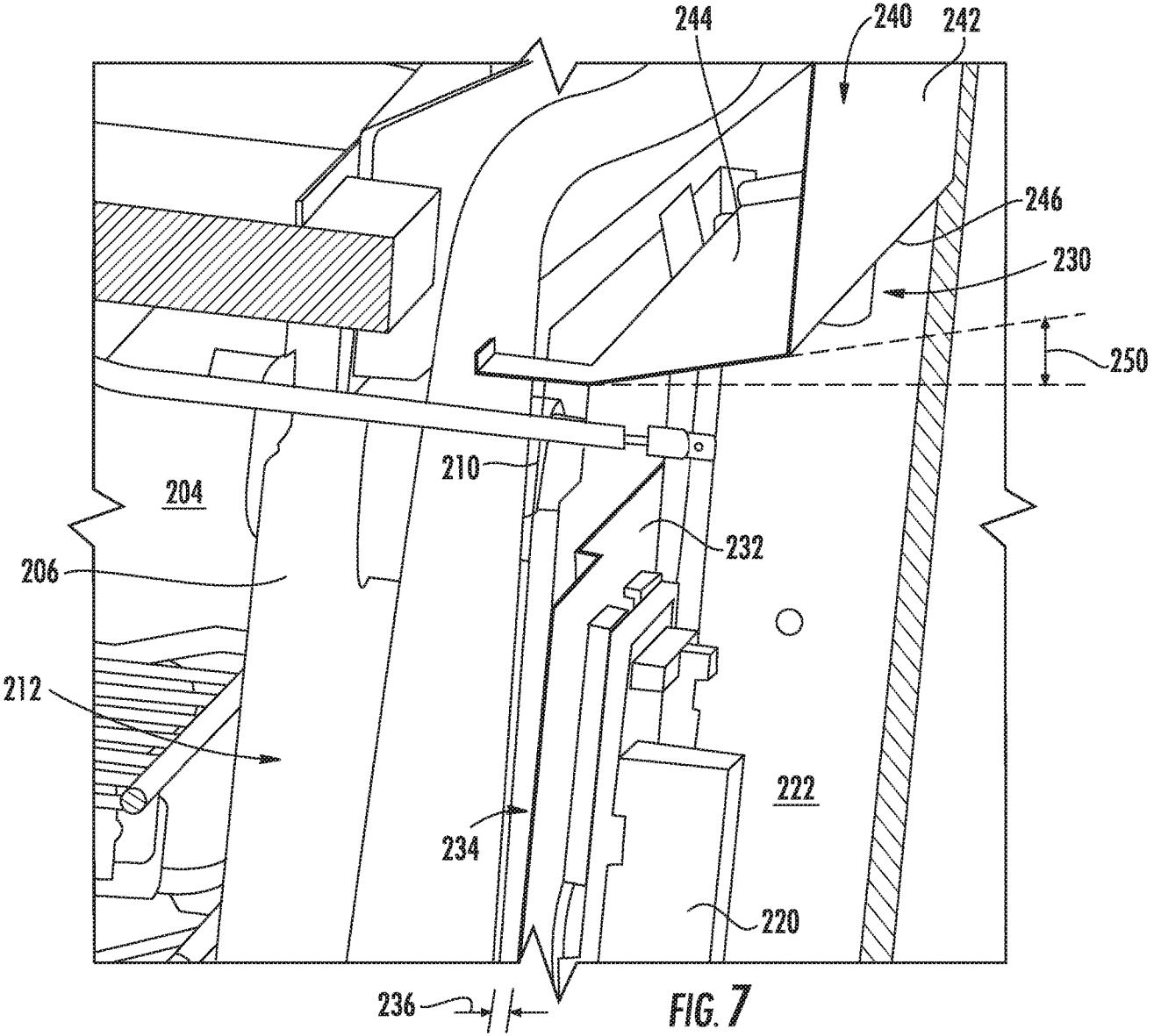
FIG. 7 is a perspective, cross-sectional view of the exemplary oven appliance of FIG. 1 taken along Line 6-6 of FIG. 1.
Figure 8:
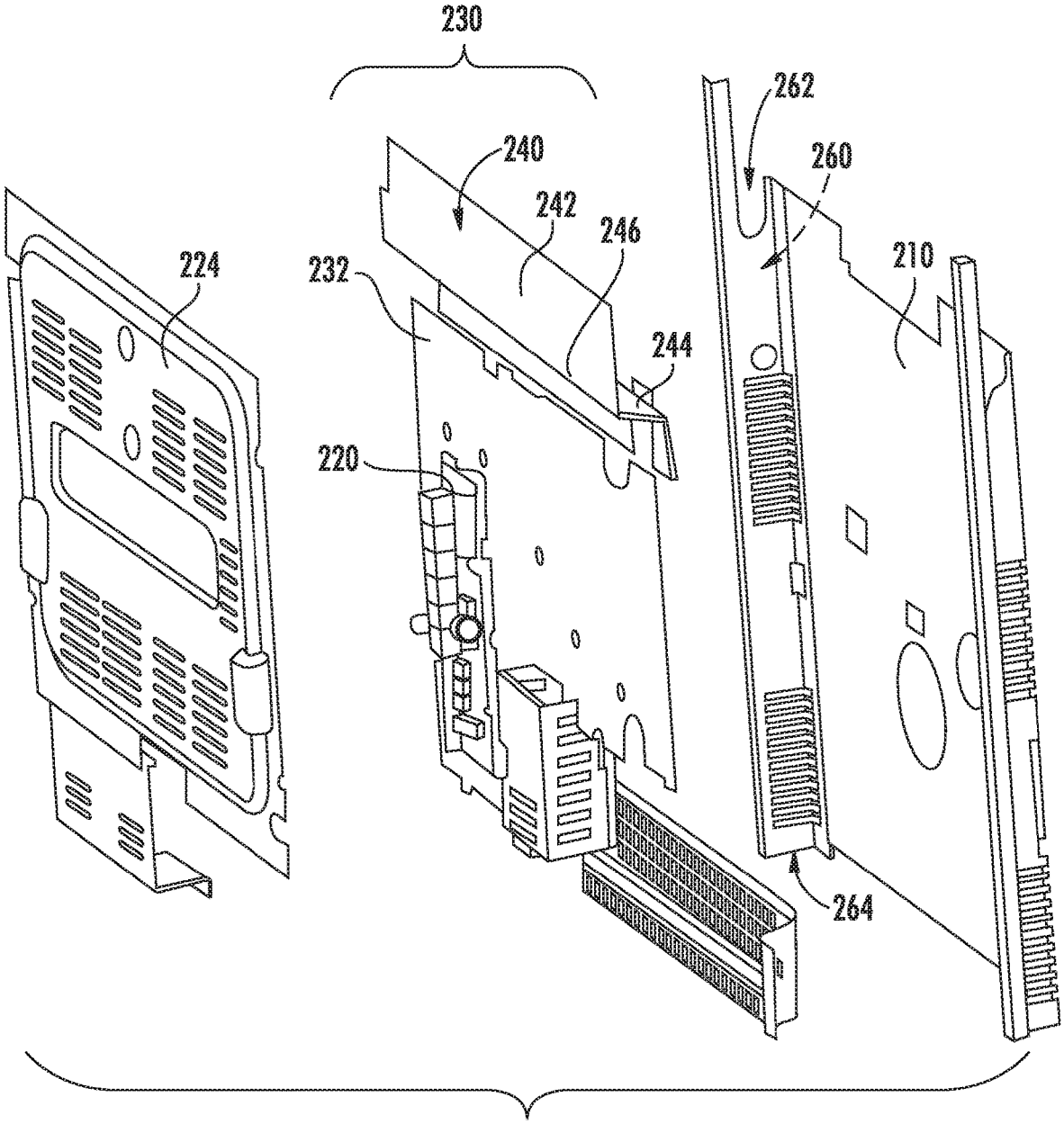
FIG. 8 is an exploded view of certain components of the exemplary oven appliance of FIG. 1 and a false back assembly according to an exemplary embodiment of the present subject matter.

As best shown in FIGS. 6 through 8, spill deflector 240 is generally positioned directly below vent apertures 202 along the vertical direction V. According to the illustrated embodiment, false back 232 and spill deflector 240 are formed as two separate components. However, it should be appreciated that according to alternative embodiments, these two components may be formed as a single, integral, and/or stamped panel or piece.

Spill deflector 240 may have any suitable shape for capturing and directing spilled fluids according to various applications. However, according to the illustrated embodiment, spill deflector 240 includes an upper plate 242 that extends substantially along the vertical direction V and a lower plate 244 that is joined to upper plate 242 at an elongated seam 246. More specifically, upper plate 242 extends proximate to vent trim 200 and is positioned behind the rearmost vent apertures 202 such that all spilled fluids are caught or deflected by upper plate 242 and directed downward along the vertical direction V toward lower plate 244.

Contrary to upper plate 242, lower plate 244 extends in a non-vertical plane for directing spilled fluids toward spill channel 234 or another suitable fluid discharge pathway. More specifically, according to the illustrated embodiment, lower plate 244 extends at a first angle 250 relative to the transverse direction T. According to the embodiment illustrated in FIGS. 6 through 8, first angle 250 is defined such that lower plate 244 extends downward along the vertical direction V relative to elongated seam 246 (i.e., toward a front 112 and bottom 106 of cabinet 102). In this manner, all fluids captured by spill deflector 240 are directed immediately into spill channel 234 where they pass down along the vertical direction V between range back 210 and false back 232 to a region below electronics compartment 222 and all sensitive electronic components 220.

According to another embodiment illustrated in FIGS. 9 through 12, first angle 250 could instead be defined such that the lower plate 244 extends upward along the vertical direction V relative to the elongated seam 246. In this manner, upper plate 242 and lower plate 244 define a V-shaped groove or a flow channel 252 that extends substantially along (and parallel to) elongated seam 246. In addition, lower plate 244 may also extend at a second angle 254 relative to the lateral direction L such that captured fluids are guided toward first side 108 or second side 110 of cabinet 102.

Referring still to FIGS. 9 through 12, when lower plate 244 is angled relative to the lateral direction L (i.e., defining second angle 254) such that spill fluids are directed towards first side 108 or second side 110 of cabinet 102, oven appliance 100 may define a vertical passageway 260 that extends along the vertical direction V for receiving spilled fluids and routing those fluids toward bottom 106 of cabinet 102. More specifically, according to the illustrated embodiment, vertical passageway 260 is defined between range back 210 and a side panel (i.e., first side 108 or second side 110) of cabinet 102. Vertical passageway 260 generally defines an upper inlet 262 positioned proximate lower plate 244 and a lower outlet 264 positioned below electronic components 220. Lower plate 244 is generally configured for routing spill fluids to upper inlet 262 where they are routed down along the vertical direction V towards lower outlet 264 and safely around electronic components 220. According to alternative embodiments, vertical passageway 260 could instead be a pipe or fluid conduit that extends from an aperture, collecting region, or low point defined by lower plate 244.

Spill deflector 240, including upper plate 242 and lower plate 244, may be formed to have any suitable shape for collecting and directing spilled fluids while minimizing splashing, sloshing, or other fluid movement which may result in fluid contact with electronic components 220. Thus, for example, first angle 250 and second angle 254 may have any suitable angle for achieving such goals. According to the illustrated embodiment, first angle 250 is less than about forty-five degrees. However it should be appreciated that first angle 250 may be less than about thirty degrees, greater than about five degrees, or may be any other suitable angle. In addition, second angle 254 is greater than about five degrees. Similarly, second angle 254 may be greater than two degrees, greater than ten degrees, greater than thirty degrees, or any other suitable angle. It should be appreciated that the geometry and configuration of spill deflector 234 as described herein is only one exemplary embodiment used the purpose of explaining aspects subject matter. Other configurations are possible within scope of the present subject matter.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. An oven appliance defining a vertical, a lateral, and a transverse direction, the oven appliance comprising:

a cabinet extending between a top and a bottom along the vertical direction;

a top panel positioned proximate the top of the cabinet, the top panel comprising vent trim defining one or more vent apertures;

an oven chamber positioned within the cabinet and being defined at least in part by a rear chamber wall;

a range back spaced apart from the rear chamber wall along the transverse direction to define an insulation gap filled with insulating material; and a false back assembly comprising:

a false back spaced apart from the range back to define a spill channel; and a spill deflector positioned below the vent apertures and above the spill channel along the vertical direction, the spill deflector configured for collecting fluids spilled through the vent apertures and directing the spilled fluids to the spill channel.

2. The oven appliance of claim 1, wherein the spill deflector comprises:

an upper plate extending substantially along the vertical direction; and a lower plate joined to the upper plate at an elongated seam, the lower plate extending at a first angle relative to the transverse direction.

3. The oven appliance of claim 2, wherein the first angle is defined such that the lower plate extends downward along the vertical direction from the elongated seam.

4. The oven appliance of claim 2, wherein the first angle is defined such that the lower plate extends upward along the vertical direction from the elongated seam to define a flow channel extending along the elongated seam.

5. The oven appliance of claim 2, wherein the first angle is less than about forty-five degrees.

6. The oven appliance of claim 2, wherein the lower plate extends at a second angle relative to the lateral direction for routing spilled fluids to a first side or a second side of the oven appliance.

7. The oven appliance of claim 6, wherein the second angle is greater than about five degrees.

8. The oven appliance of claim 6, wherein a vertical passageway is defined between the range back and a side panel of the oven appliance, the lower plate extending toward an upper inlet of the vertical passageway for routing spilled fluids into the vertical passageway.

9. The oven appliance of claim 1, wherein the spill channel extends between the bottom of and the top of the cabinet for providing a flow of cooling air through the spill channel.

10. The oven appliance of claim 1, wherein the false back and the spill deflector are formed as a single integral piece.

11. The oven appliance of claim 1, comprising:

a rear panel positioned at a rear of the cabinet, an electronics compartment being defined between the false back and the rear panel, and wherein the spill deflector is positioned above the electronics compartment along the vertical direction.

12. The oven appliance of claim 1, wherein the spill channel extends substantially along the vertical direction and is positioned between the insulation gap and an electronics compartment of the oven appliance.

13. The oven appliance of claim 1, wherein the spill channel defines a channel thickness along the transverse direction, the channel thickness being between about 5 and 10 millimeters.

14. The oven appliance of claim 1, wherein the vent trim is positioned proximate a rear of the oven appliance and extends between a first side and a second side along the lateral direction.

15. A false back assembly for an oven appliance, the oven appliance defining a vertical, a lateral, and a transverse direction and comprising a cabinet including a top panel defining one or more vent apertures and a range back positioned within the cabinet, the false back assembly comprising:

a false back spaced apart from the range back to define a spill channel;

a spill deflector positioned below the vent apertures and above the spill channel along the vertical direction, the spill deflector configured for collecting fluids spilled through the vent apertures and directing the spilled fluids to the spill channel, the spill deflector comprising:

an upper plate extending substantially along the vertical direction; and a lower plate joined to the upper plate at an elongated seam, the lower plate extending at a first angle relative to the transverse direction.

16. The false back assembly of claim 15, wherein the first angle is defined such that the lower plate extends downward along the vertical direction from the elongated seam.

17. The false back assembly of claim 15, wherein the first angle is defined such that the lower plate extends upward along the vertical direction from the elongated seam, and wherein the lower plate extends at a second angle relative to the lateral direction for routing spilled fluids to a first side or a second side of the oven appliance, and wherein a vertical passageway is defined between the range back and a side panel of the oven appliance, the lower plate extending toward an upper inlet of the vertical passageway for routing spilled fluids into the vertical passageway.

18. The false back assembly of claim 15, wherein the oven appliance comprises an oven chamber positioned within the cabinet and being defined at least in part by a rear chamber wall, wherein the range back is spaced apart from the rear chamber wall along the transverse direction to define an insulation gap.

19. An oven appliance defining a vertical, a lateral, and a transverse direction, the oven appliance comprising:

a cabinet extending between a top and a bottom along the vertical direction;

a top panel positioned proximate the top of the cabinet, the top panel comprising vent trim defining one or more vent apertures, the vent trim being positioned proximate a rear of the oven appliance and extending between a first side and a second side along the lateral direction;

an oven chamber positioned within the cabinet and being defined at least in part by a rear chamber wall;

a range back spaced apart from the rear chamber wall along the transverse direction to define an insulation gap; and a false back assembly comprising:

a false back spaced apart from the range back to define a spill channel; and a spill deflector positioned below the vent apertures and above the spill channel along the vertical direction, the spill deflector configured for collecting fluids spilled through the vent apertures and directing the spilled fluids to the spill channel.

20. The oven appliance of claim 19, wherein the spill deflector comprises:

an upper plate extending substantially along the vertical direction; and a lower plate joined to the upper plate at an elongated seam, the lower plate extending at a first angle relative to the transverse direction.

* * * * *